US005819433A

United States Patent [19]

Crooks

[11] Patent Number: 5,819,433

[45] Date of Patent: Oct. 13, 1998

[54] BOOT DRYER

[76] Inventor: Dennis J. Crooks, 13983 Humo Dr., Poway, Calif. 92064

[21] Appl. No.: 894,847

[22] PCT Filed: Feb. 21, 1996

[86] PCT No.: PCT/US96/02499

§ 371 Date: Aug. 15, 1997

§ 102(e) Date: Aug. 15, 1997

[87] PCT Pub. No.: WO96/26405

PCT Pub. Date: Aug. 29, 1996

Related U.S. Application Data

[63] Continuation-in-part of Ser. No. 394,463, Feb. 27, 1995, abandoned.

[51] Int. Cl.[6] ..... F26B 25/00

[52] U.S. Cl. ..... 34/104

[58] Field of Search ..... 34/417, 437, 440, 34/441, 442, 103, 104, 106, 107; 219/400; 392/379, 380

[56] References Cited

U.S. PATENT DOCUMENTS

| | | | |
|---|---|---|---|
| 4,171,580 | 10/1979 | Vabrinskas | 34/104 |
| 4,592,497 | 6/1986 | Georges | 34/104 |
| 4,774,769 | 10/1988 | Dollst | 34/104 |
| 5,003,707 | 4/1991 | Chu | 34/104 |
| 5,179,790 | 1/1993 | Poulos | 34/104 |
| 5,289,642 | 3/1994 | Sloan | 34/104 |
| 5,570,515 | 11/1996 | Schulte | 34/104 |
| 5,720,108 | 2/1998 | Rice | 34/104 |

*Primary Examiner*—Henry Bennett
*Assistant Examiner*—Steve Gravini
*Attorney, Agent, or Firm*—John R. Ross; John R. Ross, III

[57] ABSTRACT

A boot dryer (1) comprising an electric motor driven blower which is contained in a blower housing (2). The blower forces air past a deodorizer pad and through a flexible hose (16) which is placed inside a boot. A toe piece attached at the end of the flexible hose prevents flow blockage. In a preferred embodiment, a liquid deodorizer is applied through a port in the blower housing onto an absorbent pad mounted within the dryer. The flexible hose (16) may be detached and the blower driven by a small battery so that the blower portion of the unit can be easily carried by back packers.

14 Claims, 11 Drawing Sheets

BOOT DRYER

This application is a continuation in part of U.S. patent application Ser. No. 394,463, filed Feb. 27, 1995, abandoned. This invention relates to drying devices and in particular to boot dryers.

BACKGROUND OF THE INVENTION

Many devices for drying boots have been proposed. Many of the devices include a blower to blow air into the boot. Some of these devices comprise a heating element heating the air blown into the boot. Hot air can cause damage to the boot and heating the air can be a waste of energy, especially if the humidity of the surrounding air is already low. It is known to provide tubes in a U or V shape in order to blow air from one blower into two boots at the same time.

Drying boots and shoes often produce unpleasant odors, especially when hot air dryers are used. This is not a sever problem in a drafty mountain cabin but in a small modern well insulated condominium, skiers may be forced to open the windows because of the stink from drying boots. The humidity of the air in modern mountain condominiums is usually low, especially in the winter.

What is needed is an energy efficient boot dryer that will not stink up the condominium.

SUMMARY OF THE INVENTION

The present invention provides a boot dryer. An electric motor driven blower contained in a blower housing forces air past a deodorizer pad and through a flexible hose which is placed inside a boot. A toe piece attached at the end of the flexible hose prevents flow blockage. In a preferred embodiment a liquid deodorizer is applied through a port in the blower housing onto an absorbent pad mounted within the dryer. The flexible hose may be detached and the blower driven by a small battery so that the blower portion of the unit can be easily carried by back packers. Preferred embodiments include dryers for a single boot, a single pair of boots and dryers for a large number of boots. A variable power supply permits operation at various speeds.

DETAILED DESCRIPTION OF PREFERRED EMBODIMENTS

Preferred embodiments of the present can be described by reference to the drawings.

Single Boot Unit

Figure 1:
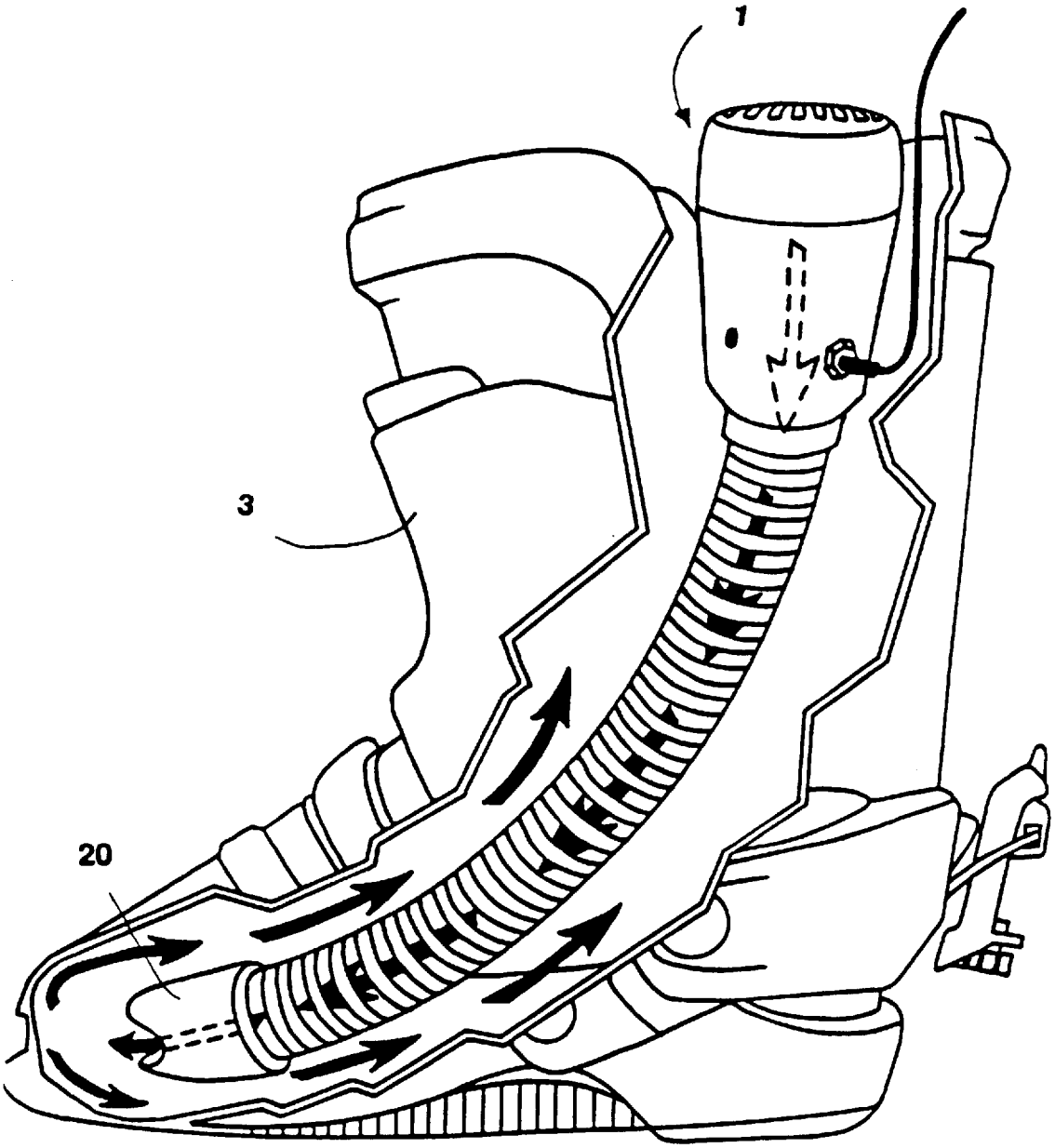
FIG. 1 shows a preferred embodiment of the present invention drying a boot.
Figure 2:
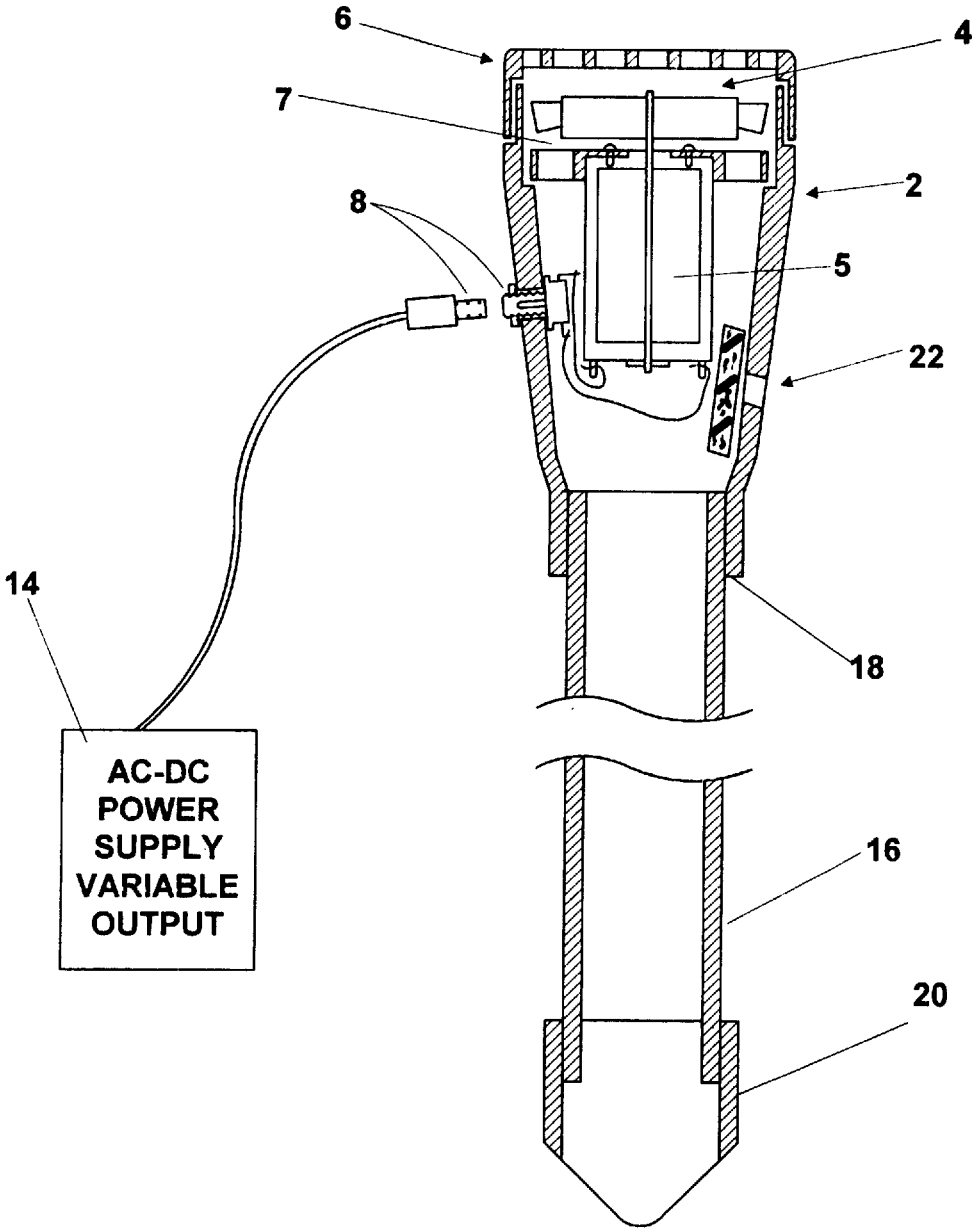
FIG. 2 is a cross sectional drawing of this preferred embodiment.

FIG. 1 is a cutaway drawing of a boot dryer 1 constituting a preferred embodiment of the present invention. The dryer 1 is shown in the process of drying a boot 3. FIG. 2 is a cross sectional drawing of dryer 1. The dryer comprises blower housing 2 which contains fan unit 4 and is covered by cap 6. A conventional 12 Volt power jack 8 provides for easy connection of a 12 Volt power supply 14. The exit end of blower housing has a 1.25 inside diameter. One end of a 16 inch length of Flex hose 16 which has a 1.25 outside diameter fits snugly into the outlet end of blower housing 2 as shown at 18 in FIG. 2. The opposite end of flex hose 16 is heated and bent into an oval shape as shown in FIG. 1. Special toe piece 20, containing an oval shaped passage way through it, fits on the oval shaped end of flex hose 16. Blower housing 2 contains a ¼ inch diameter hole in its wall as shown at 22 in FIG. 2 and a 1 square inch felt pad is attached to the inside wall with a suitable glue.

Figure 3C:
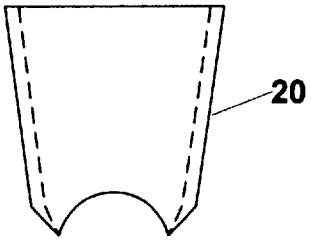
FIGS. 3A, B and C show views of the toe piece of the above embodiment.
Figure 3A:
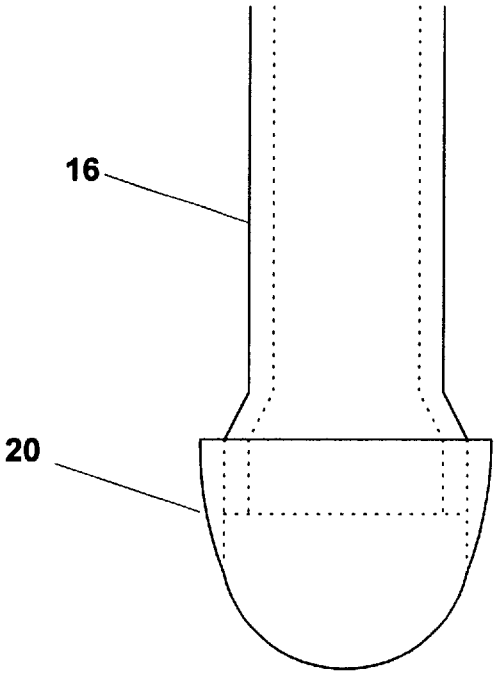
Figure 3B:
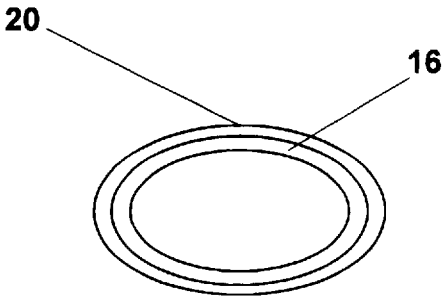
Figure 6:
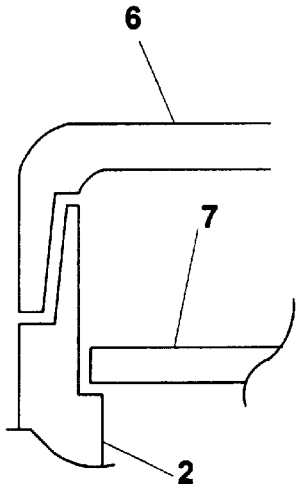
FIGS. 4, 5 and 6 show views of the cap of the above embodiment.
Figure 4:
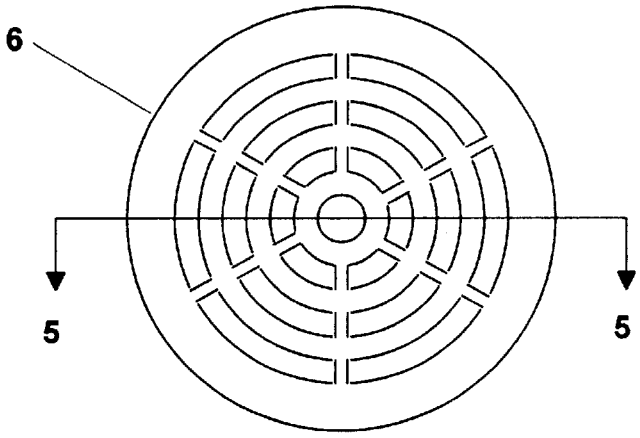
Figure 5:
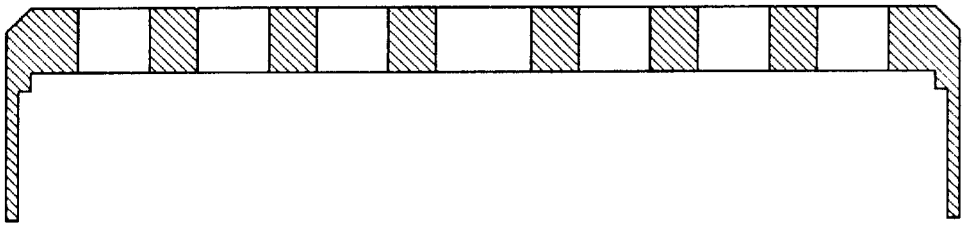
Figure 7:
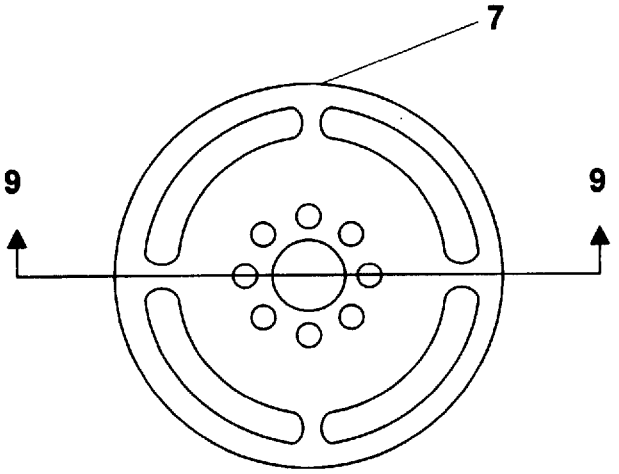
FIGS. 7, 8 and 9 show views of the motor mount of the above embodiment.
Figure 8:
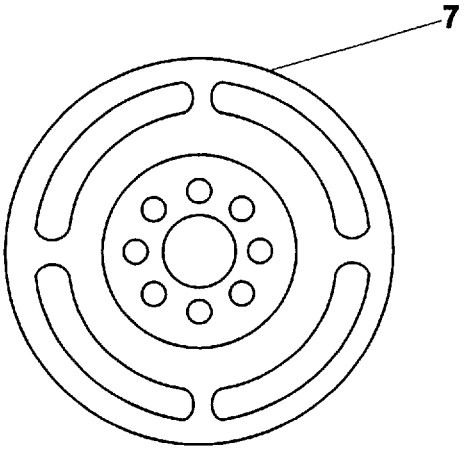
Figure 9:
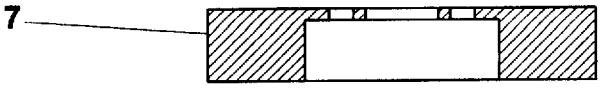

In this preferred embodiment the fan unit is a Model No. 2C0907C2 supplied by Thorgren Tool land Molding Co. Inc. This unit contains a 24-12 Volt 14,777 RPM motor 5, Model No. HC315 MG-3535 supplied by Johnson Electric North America Inc., Fairfield, Conn. 06430. The flex hose is PVC standard duty clear Spiralilte 115 Manufactured by Pacific Echo, Inc. Special toe piece is ABS plastic. Its design is such, as shown in FIGS. 3A, B and C, that air flow cannot be blocked when tip of the boot dryer is pressed against the tip of the boot. FIG. 3A is a top view, FIG. 3C is a side view and FIG. 3B is a view looking into the exit of the unit. The 12 Volt power jack 8 is a Model No. 163-4304 which is a split pin, 2.1 mm jack distributed by Mouser Electronics 11433 Woodside Ave. Santee Calif. 92071-4795 and the power supply 14 is a Model WP481012D made by Pacific Phoenix Inc. The input to this power supply (transformer) is 120 VAC, 20 Watt, and the output is 12 Volt DC and 1000 mA. Blower housing 2 is specially molded with the shape as shown in FIG. 2. The design of cap 6 is shown in FIGS. 4, 5 and 6 and it is constructed from ABS plastic. FIG. 6 shows how in the cap 6 and motor mount 7 fits on blower housing 2. Motor 5 is mounted to motor mount 7 with screws as shown in FIG. 2. Top, bottom and cross sectional views of motor mount 7 are shown in FIGS. 7, 8 and 9, respectively.

To use the device merely place about two drops of a liquid deodorizer such as that made by Willert Home Products, 4044 Pack Ave., Saint Louis Mo. 63110, then stick the toe end of the dryer into a boot as far as it will go then plug it in. With this embodiment, only one at a time can be dried. Most persons may find it convenient to purchase two units so drying of both boots at the same time can be accomplished. Applicant has tested the above embodiment many times in winter conditions in typical mountain vacation condominiums. The drying times average about 30 minutes per boot.

Figure 10:
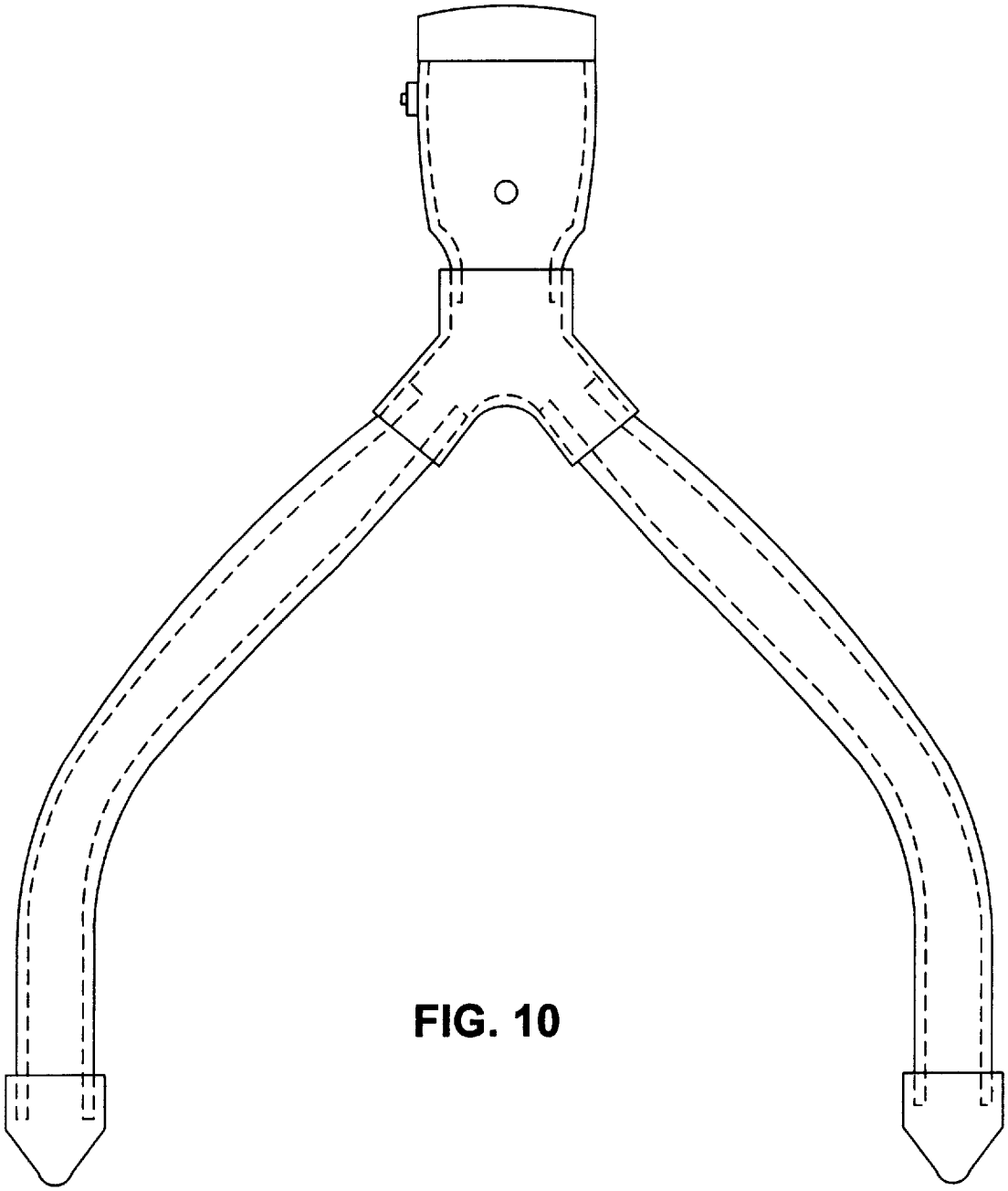
FIG. 10 is a drawing of a two boot dryer.
Figure 16:
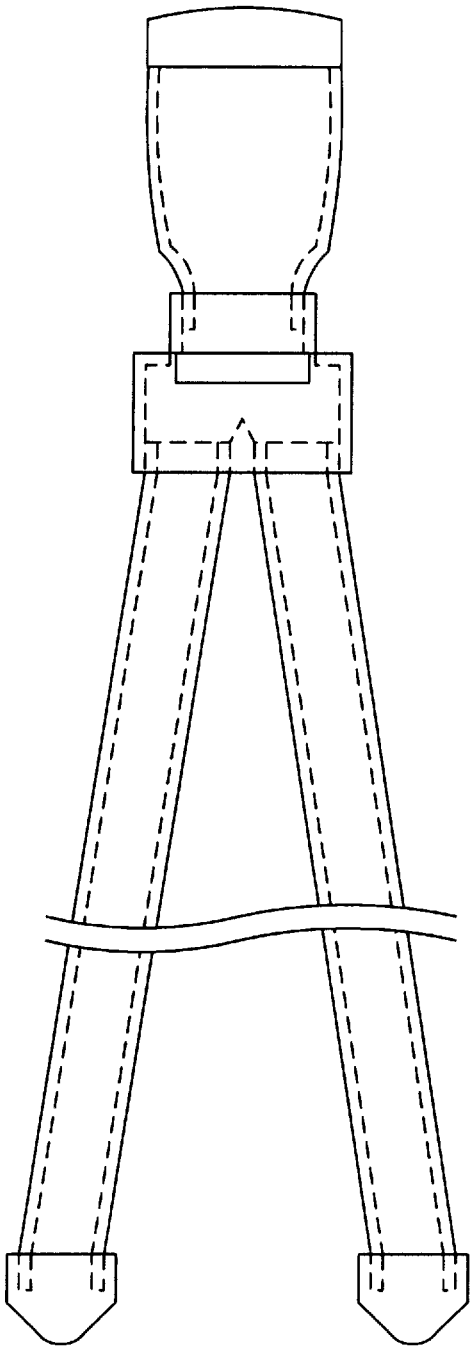
FIG. 16 is a drawing of a two-boot embodiment.

Two Boot Unit A two boot version of the present device is shown in FIGS. 10 and 16. These two units are similar to the one boot unit except these units have a wye piece which fits over the discharge end of the blower housing and has two flex hoses and two toe pieces. In the device shown in FIG. 16, the fan is a model No. 2C89S7 V2 supplied by Thorgren Tool and Molding 1100 Evans Ave., Valparailo, Ind. 46383. This unit contains a 6–18 Volt DC brush motor 027.7 mm ×32.6 mm long with a permanent magnet Model No. HTBRRO2803205C-0001 supplied by HTI, 13340 East Firestone Blvd., Unit J, Santa Fe Springs Calif. 90670-5559. The power supply is a 120 VAC transformer to 6 V/12 V/18 VDC, rated at 1000 ma,UL listed, also supplied by HTI. The speed of the fan and the power consumed is determined by the voltage selected. High speed 18 V, medium speed 12 V and low speed 6 V. The DC power jack is a Model No. 16PJ100 which is a 2.5 mm Jack distributed by Mouser Electronics 11433 Woodside Ave., Santee Calif. 92071-4795. The blower housing is specially injection molded ABS plastic as shown in FIG. 2. It has an exit bore of 1.25 inches nominal with a 2 degree draft to accommodate a snug fit on the hose as it is inserted into the housing exit as shown in FIG. 2. The OD of the housing 2 exit is 1.5 inches nominal so as to make a snug fit when mated to the inlet orifice of the wye as shown in FIG. 16. The wye piece is specially injection molded of ABS plastic in the shape shown in FIG. 16. The two outlets are sized at 1.25 inches nominal with a 2 degree draft to accommodate a snug fit on the hoses as they are inserted. The hoses are SILVERADO flex hoses with Forge-Loop construction with a 1.25 inch OD critical. The hose is manufactured by Panther Flex Industries, 6451 El Camino Real, Carlsbad Calif. 92009. The motor mount and special toe pieces are specially injection molded as shown in FIG. 7,8,9, and FIG. 3A 3B and 3C, respectively. The toe pieces are generally oval shaped in the axial direction as shown in FIG. 3B. The side cut-outs shown in FIG. 3C prevent flow blockage when the toe pieces are inserted into the toe portions of boots.

Back Pack Unit

Figure 11:
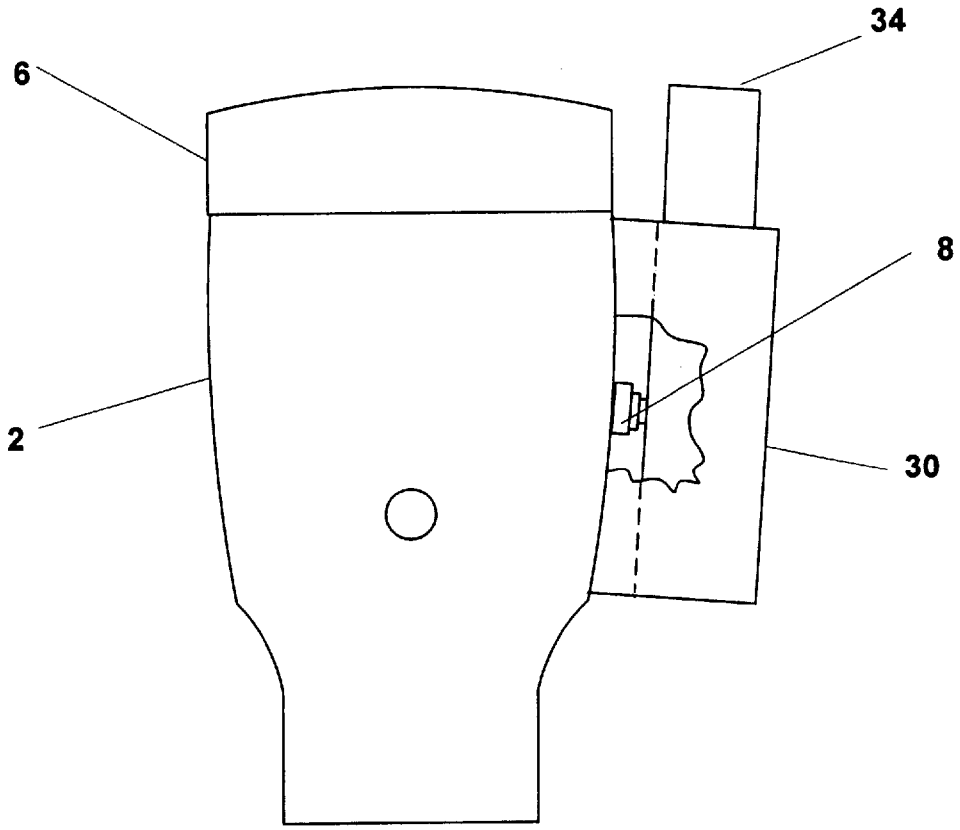
FIG. 11 shows a back packing version.
Figures 12, 13, 14:
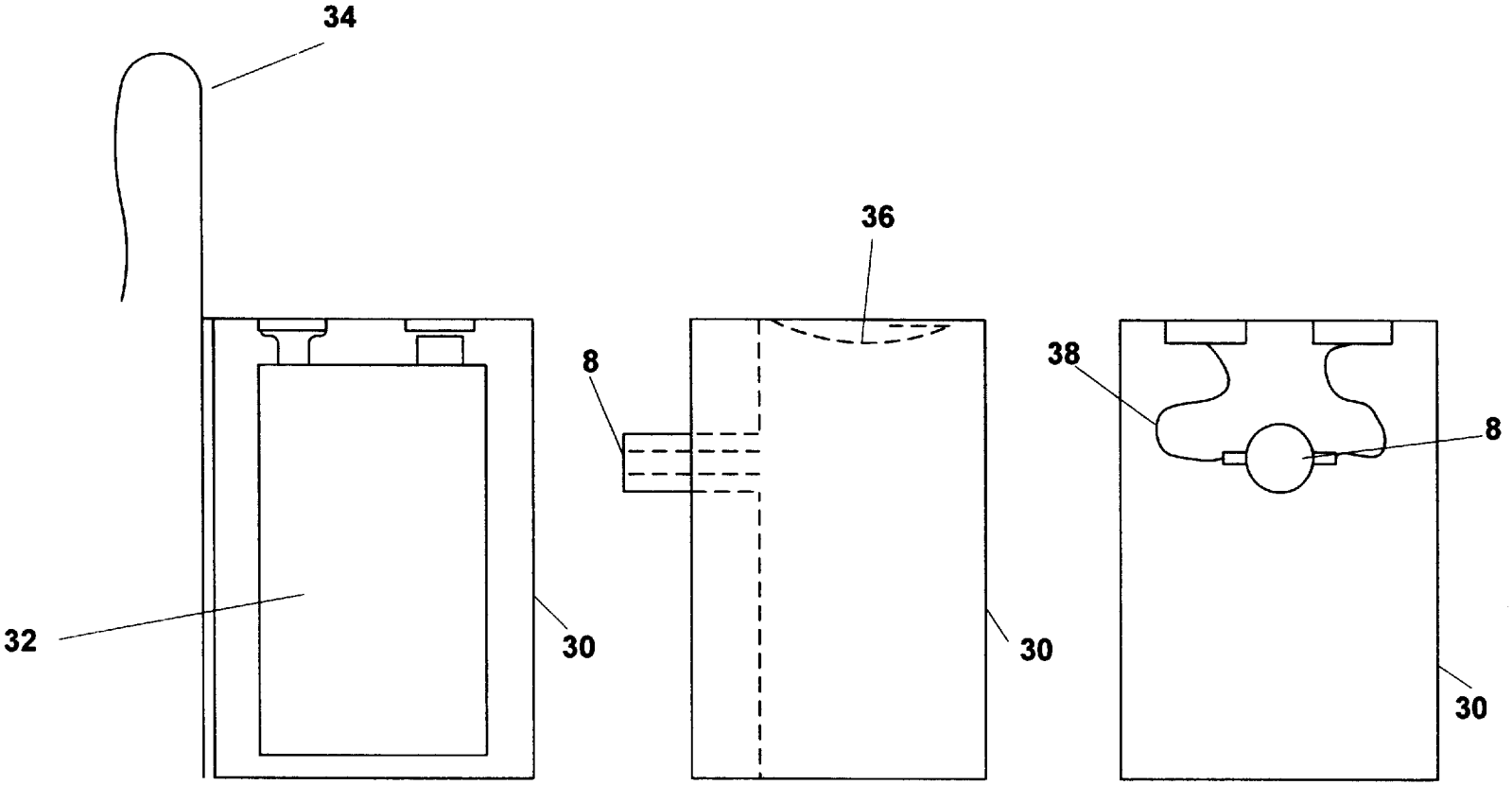
FIGS. 12, 13 and 14 shows a battery pack for the FIG. 1 embodiment.

Portions of this embodiment can be used as a back packing unit as shown in FIG. 11. Here the hose 16 is not included and battery case 30 and battery 32 is substituted for the power supply equipment shown in FIGS. 1 and 2. The battery cans 30 is shown in FIGS. 12, 13 and 14. Clip 34 is used to hold the unit in place at the mouth of the boot.

Figure 15:
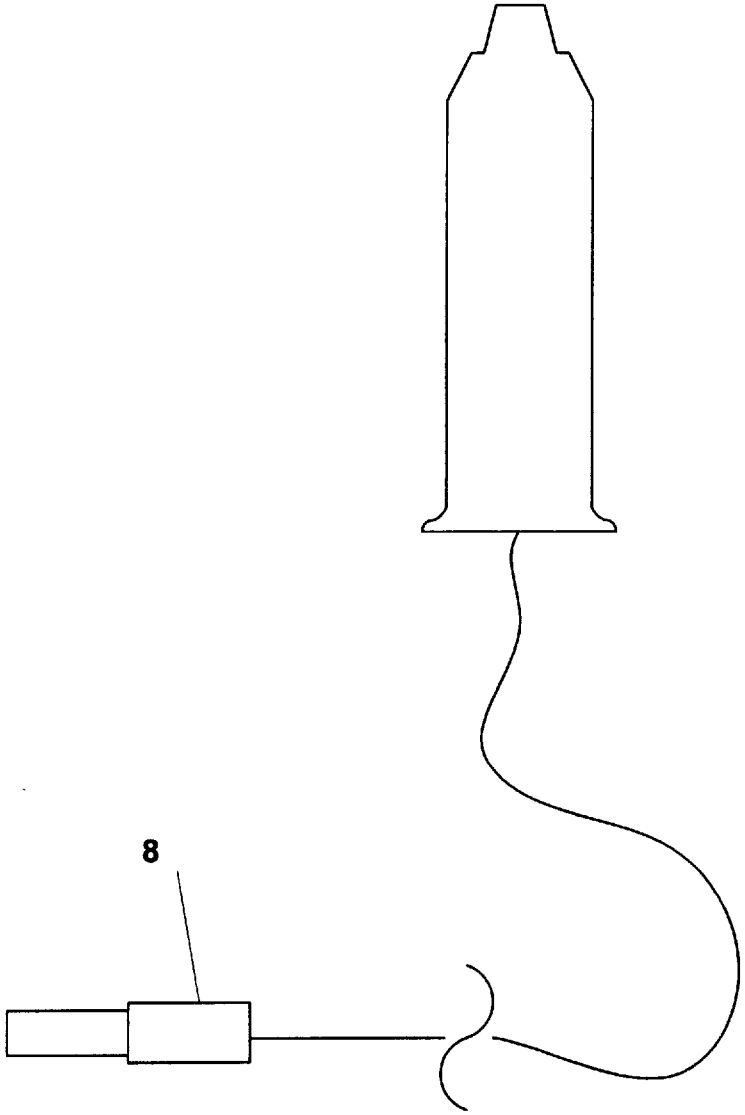
FIG. 15 is a drawing of a cigarette lighter adapter.

Other Power Sources FIG. 15 shows a cigarette lighter adaptor which can be used to power the unit from an automobile cigarette lighter.

Commercial Unit

Figure 17B:
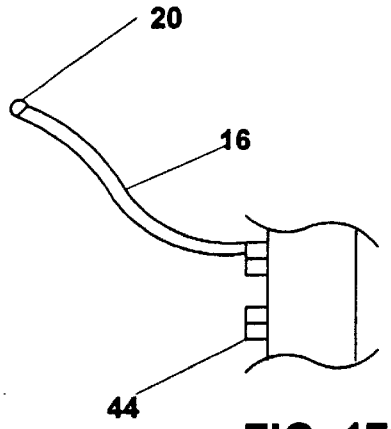
FIGS. 17A and 17B are drawings of an embodiment for drying a large number of boots.
Figure 17A:
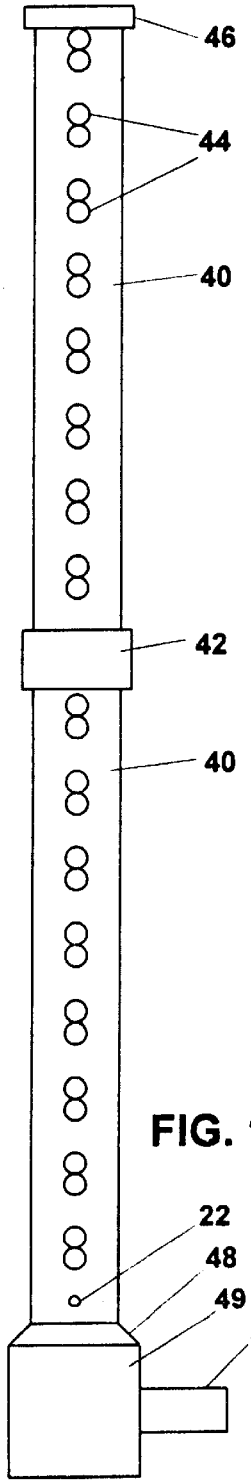

FIGS. 17A and 17B are drawings of a preferred embodiment for drying a large number of boots simultaneously. The principal additional components of this embodiment are a much larger motor-blower unit 50 and 49 and a tubular header constructed from two 3½ foot lengths of 4-inch ABS drain pipe 40. The motor blower is a 240 CFM air flow unit at a head pressure of 0.75 inches of water. I purchased the unit from the Granger catalog ( Granger Stock number 46445, Shaded Pole Blower). A rubber coupling 48 couples the motor-blower unit to the 4-inch header. In this unit, a ⅜-inch diameter hole is bored in header 40 at location 22 with a one inch felt pad glued to the inside surface of the header pipe permits the deodorant solution to be utilized in the large scale situation. A 4-inch coupling 42 connects the two sections of pipe and an 4-inch cap 46 covers the end of the header. Holes are cut in the pipe for insertion of wye units 44 which are shown in FIG. 16. Flex hoses 16 and toe pieces 20 are the same as those shown in FIG. 16 and described above. The larger motor-blower unit provides sufficient air flow for to dry 12 or more pairs of boots simultaneously. The length of time for drying depends on many obvious factors such as the number of boots, their wetness, the humidity of the ambient air. Additional pipe sections can be added with utilizing 4-inch couplings, elbows or tees. The unit if not glued together permanently can be easily slipped apart and stored after the drying is done.

Drying Clothes Hanger

Figure 18:
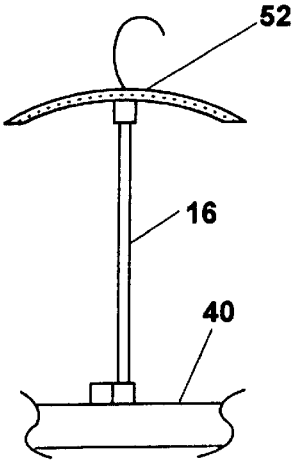
FIG. 18 shows a hollow perforated coat hanger attached to the FIGS. 17A and 17B embodiment for drying wet jackets.

FIG. 18 shows a clothes hanger. It consists of 1-inch ABS plastic tubing formed into the shape of an arc. It is open at both ends with small holes drilled through the sides top and bottom of the tube. Under the hook, is a 1.25 inch ID fitting with 2 degree draft that the discharge hose of the commercial unit as shown in FIG. 18, or the discharge hose of the basic boot dryer, will fit into snugly. Air is discharged into this hanger and air flows out the holes and the ends thus drying and deodorizing the jacket from the inside.

While the above description contains many specificities, the reader should not construe these as limitations on the scope of the invention, but merely as exemplifications of preferred embodiments thereof. Those skilled in the art will envision many other possible variations that are within its scope. For example, the discharge ends of the dryer units could be inserted into a clothes bag to deodorize and freshen a garment inside. An inlet and one or more outlets can be provided by the user. The number of outlets in the commercial unit could be any number but preferably at least 12 would be provided. Accordingly, the reader is requested to determine the scope of the invention by the appended claims and their legal equivalents and not by the examples which have been given.

I claim:

1. A boot dryer comprising:

A) a electric motor driven blower,

B) an electrical connection means for connecting an electrical power source to said blower, C) a flexible hose defining two ends and attached at one end to said blower housing, D) a toe piece means attached at the other end of said flexible hose, E) an absorbent pad means mounted within said dryer absorbing a liquid deodorizer.

2. A boot dryer as in claim 1 wherein said electric motor driven blower in contained in a blower housing comprises an absorbent port and said absorbent pad is mounted inside said housing covering said port.

3. A boot dryer as in claim 1 and further comprising a power source.

4. A boot dryer as in claim 2 wherein said power source is a plug-in transformer unit.

5. A boot dryer as in claim 2 wherein said power source is a battery.

6. A boot dryer as in claim 1 wherein said toe piece means defines an essentially oval shaped cross section passage way.

7. A boot dryer as in claim 3 wherein said power source comprises a battery pack and a battery.

8. A boot dryer as in claim 3 wherein said flexible hose is detachable from said blower housing.

9. A boot dryer as in claim 6 wherein said toe piece means is configured to prevent flow blockage when inserted to a toe section of a boot.

10. A boot dryer comprising:

A) a blower housing,

B) a electric motor driven blower contained in said blower housing,

C) an electrical connection means for connecting an electrical power source to said blower, D) a flexible hose defining two ends and detachably attached at one end to said blower housing, E) a toe piece means attached at the other end of said flexible hose, F) a battery pack and a battery, G) an absorbent pad means mounted within said dryer absorbing a liquid deodorizer.

11. A boot dryer comprising:

A) a electric motor driven blower,

B) an electrical connection means for connecting an electrical power source to said blower, C) a wye piece means for receiving air flow from said blower, D) two flexible hose each hose defining two ends and attached at one end to said blower housing, E) two toe piece means each toe piece means attached at the other end of said flexible hose, F) an absorbent pad means mounted within said dryer absorbing a liquid deodorizer.

12. A multiple boot dryer unit comprising:

A) a electric motor driven blower,

B) an electrical connection means for connecting an electrical power source to said blower, C) a header receiving air flow from said blower, D) at least 12 flexible hoses each hose defining two ends and attached at one end to said header, E) at least 12 toe pieces each toe piece attached at the other end of one of said flexible hoses, F) an absorbent pad means mounted within said dryer absorbing a liquid deodorizer.

13. A garment boot dryer kit comprising:

A) an electric motor driven blower,

B) an electrical connection means for connecting an electrical power source to said blower, C) a flexible hose defining two ends and attached at one end to said blower housing, D) a toe piece means attached at the other end of said flexible hose, E) an absorbent pad means mounted within said dryer absorbing a liquid deodorizer, F) a coat hanger comprised of:

1) a hanging hook 2) a hanger support comprised of a tube having a large number of air exit holes and one inlet aperture sized to fit said other end of said flexible tube.

14. A garment boot dryer kit comprising:

A) an electric motor driven blower,

B) an electrical connection means for connecting an electrical power source to said blower, C) a flexible hose defining two ends and attached at one end to said blower housing, D) a toe piece means attached at the other end of said flexible hose, E) an absorbent pad means mounted within said dryer absorbing a liquid deodorizer, F) a garment bag with an air inlet hole for one end of said flexible hose and at least one air outlet hole.

* * * * *